United States Patent [19]

Turner et al.

[11] Patent Number: 4,918,841

[45] Date of Patent: Apr. 24, 1990

[54] ATHLETIC SHOE WITH IMPROVED MIDSOLE

[76] Inventors: Jerome P. Turner, 25742 Buckles Bucklestone Ct., Laguna Hills, Calif. 92653; John W. Thomas, 36 Christamon W., Irvine, Calif. 92714

[21] Appl. No.: 303,945

[22] Filed: Jan. 30, 1989

[51] Int. Cl.[5] ..... A43B 13/14; A43B 13/18; A43B 13/04

[52] U.S. Cl. ..... 36/114; 36/28; 36/114; 36/31

[58] Field of Search ..... 36/114, 30 R, 31, 32 R, 36/28, 103, 30 A, 59 C, 10 B, 30 A, 107

[56] References Cited

U.S. PATENT DOCUMENTS

| | | | |
|---|---|---|---|
| 4,128,950 | 12/1978 | Bowerman et al. | 36/30 R |
| 4,391,048 | 7/1983 | Lutz | 36/30 R |
| 4,430,810 | 2/1984 | Bente | 36/32 R |
| 4,598,487 | 7/1986 | Miseuch | 36/114 |
| 4,641,438 | 2/1987 | Laird et al. | 36/59 C |
| 4,730,402 | 3/1988 | Norton et al. | 36/30 R |
| 4,794,707 | 1/1989 | Franklin et al. | 36/30 R |
| 4,817,304 | 4/1989 | Parker et al. | 36/114 |

*Primary Examiner*—Steven N. Meyers

*Attorney, Agent, or Firm*—Hedman, Gibson, Costigan & Hoare

[57] ABSTRACT

A novel athletic shoe is disclosed which has a midsole in which is provided a resilient member having parallel grooves which in cross-section have a triangular profile.

7 Claims, 2 Drawing Sheets

ATHLETIC SHOE WITH IMPROVED MIDSOLE

FIELD OF THE INVENTION

The present invention relates to an athletic shoe construction having shock absorbing and kinetic energy returning elements in the heel portion of the sole.

BACKGROUND OF THE INVENTION

Various designs exist to introduce shock absorbing elements into athletic shoes. For example, Giese et al., U.S. Pat. No. 4,316,332, discloses an athletic shoe construction having shock absorbing elements in the heel and forefoot areas of the sole portion of the shoe. These elements are surrounded on their sides by comparatively hard rim portions of a sole shell or midsole. Also, Stirtz et al., U.S. Pat. No. 4,297,796, discloses a shock-absorbing system for athletic shoes, the shoes having a foot-cushioning inner sole member to one face in which, and to at least a portion of the rim in which, is bonded an open mesh web. The interwoven strands of the web act as force-transmitters with respect to the sole member, and cause a localized foot-produced deformation in the member to be distributed to other regions in the member.

The applicant has devised a novel system to increase the performance of athletic shoes by introducing elements into the soles of athletic shoes that provide excellent shock attenuation and kinetic energy returning properties. The kinetic energy returning property refers to the ability of a material to quickly return to its original shape after deformation, the deformation resulting from the effect of kinetic energy received from another source. For example, rubber balls have excellent kinetic energy returning properties as evidenced by their immediate and sharp bounce when thrown against a surface. Athletic shoes having such shock attenuation and kinetic energy returning properties are desirable because shock attenuation reduces the possibility of injury to the wearer and a kinetic energy returning property imparts a "springiness" quality to the shoes.

The present invention achieves the desired objectives by a coupled two module unit that is inserted into a cavity located in the heel portion of the midsole. One module component of the unit is a rubber containing material, this module being much softer than the other module of the unit.

The present invention comprising certain novel features and a combination of parts is hereinafter fully described and illustrated in the accompanying drawings and is particulary pointed out in the appended claims. It is understood that various changes in the particulars may be made without departing from the spirit of substance of the present invention.

SUMMARY OF THE INVENTION

The present invention pertains to an athletic shoe comprising an upper shoe connected to a multilayer sole, said multilayer sole comprising in combination:

(a) an inner sole;

(b) an outer sole;

(c) a midsole intermediate between said inner and outer sole, said midsole having a cavity which is provided with a resilient member said resilient member comprising a first module having one or more parallel grooves which in cross-section have a triangular profile and a second module having one or more parallel raised strips which in crosssection have a triangular profile, said second module being joined to said first module by insertion of the raised strips of said second module into the grooves of said first module, and said joined first and second modules being located in said cavity of said midsole.

In preferred embodiments, the first module is made of a semi rigid material and the second module is made of a highly resilient elastomeric rubber containing material. The function of the joined modules in the midsole is to impart shock absorbing and kinetic energy returning properties to the athletic shoe.

DETAILED DESCRIPTION OF THE INVENTION

The athletic shoe of the present invention has an improved midsole which contains a resilient member in a midsole cavity, this novel athletic shoe having excellent shock absorbing and kinetic energy returning properties.

The novel resilient module of the present invention is based on the use of a highly resilient inner layer that provides enhanced rebound properties.

The enhanced rebound is obtained by the use of a stiff reinforcing undulating surface which is filled on both sides with a low hysteresis elastomer is exposed to impact loading, it will exhibit a very high rebound effect because the energy of compression is not converted to heat energy. The low hysteresis elastomers are generally unfilled and unplasticized materials. Natural rubber is an excellent material for this use although other materials such as polyisoprene may be used.

The novel multilayer structure provides the combined wear resistant properties of materials such as a outer layer of a filled polyurethane with an inner reinforced rebound layer.

Figure 1:
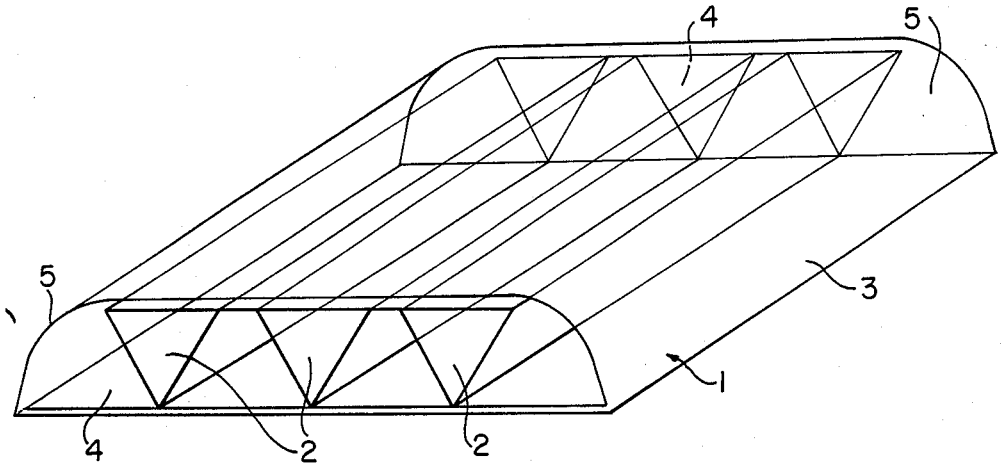
FIG. 1 is of the clear plastic first module. The module has preferably three or four parallel triangularly shaped grooves designed to hold the second module which is represented by FIG. 2.

The reinforced inner layer may be made from polyvinyl chloride reinforcing member as shown in FIG. 1. This reinforcing member is preferably filled on one side with the low hysteresis elastomer.

The triangular raised strips 7 should be sized so that the flat surface 8 extends out of the first module 1. This provides a resilient outer surface which has the properties of a solid rubber surface but is firmly held in a defined space which prevents the rubber insert from being deformed or moved out of position under the calcaneous bone.

As best seen in FIG. 1, first module 1 is a rectangularly shaped component with flat base 3, opposite flat walls 4, and opposite curved walls 5. There are also several parallel grooves 2, which has a triangular profile. In the preferred embodiment, the first module 1 is made of a clear plastic and has a number of grooves, preferably three or four grooves which have a triangular profile running lengthwise along the longer axis of the first module 1. Especially preferred is a plastic first module 1 with a Shore A hardness of 50°-60° and with the flat walls 4 and the base 3 being approximately 2 mm. thick. Polyvinyl chloride may be utilized as the material for the first module.

Figure 2:
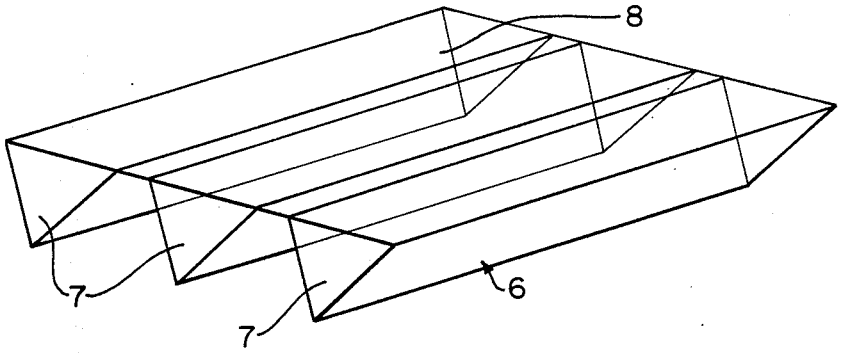
FIG. 2 is of the second module with parallel triangularly shaped raised strips, preferably three or four, the strips being designed to fit into the grooves of the plastic first module. The joined modules are then inserted into a midsole of an athletic shoe.

Referring to FIG. 2, the second module 6 has a flat surface 8 and several parallel raised strips 7, descending from the surface 8. In the preferred embodiment, there are three or four raised strips 7, each triangularly shaped with a blunted tip. Also, the second module 6 is preferably made with an elastomeric material such as natural or synthetic rubber. According to the present invention, the raised strips 7 of the second module 6 are designed to fit into the parallel grooves 2 of the first module 1, so that the first and second modules can be joined together as a single unit.

Figure 3:
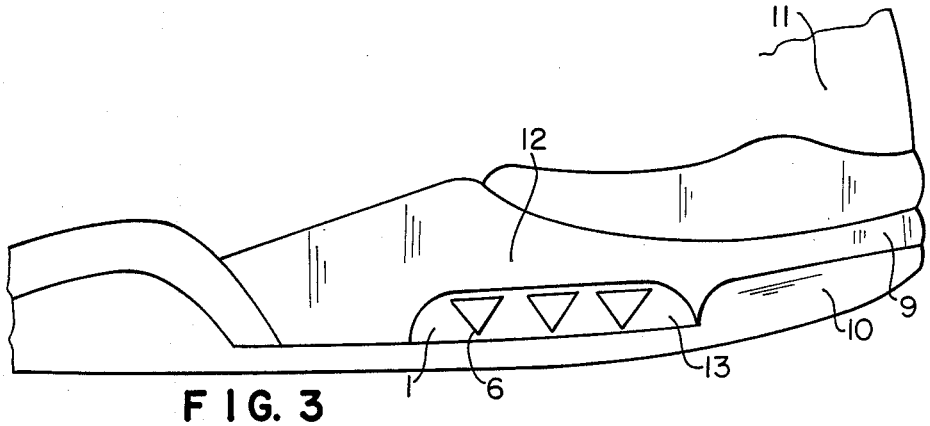
FIG. 3 is a side view of an athletic shoe sole. The midsole has a cavity to accommodate the joined modules.

As shown in FIG. 3, the midsole 9 is intermediate between the outer sole 10 and the upper shoe 11. In the midsole 9, there is located at the heel portion 12 a cavity 13 which contains the joined first and second modules. In the preferred embodiment, the joined modules are positioned transversely across the width of the athletic shoe such that the parallel grooves 2 and parallel raised strips 7 lie perpendicular to the longitudinal axis of the athletic shoe. Moreover, in the preferred embodiment, the modules are positioned within the cavity 13 such that the base 3 of the first module 1 lies against the top of the outer sole 10.

Figure 4:
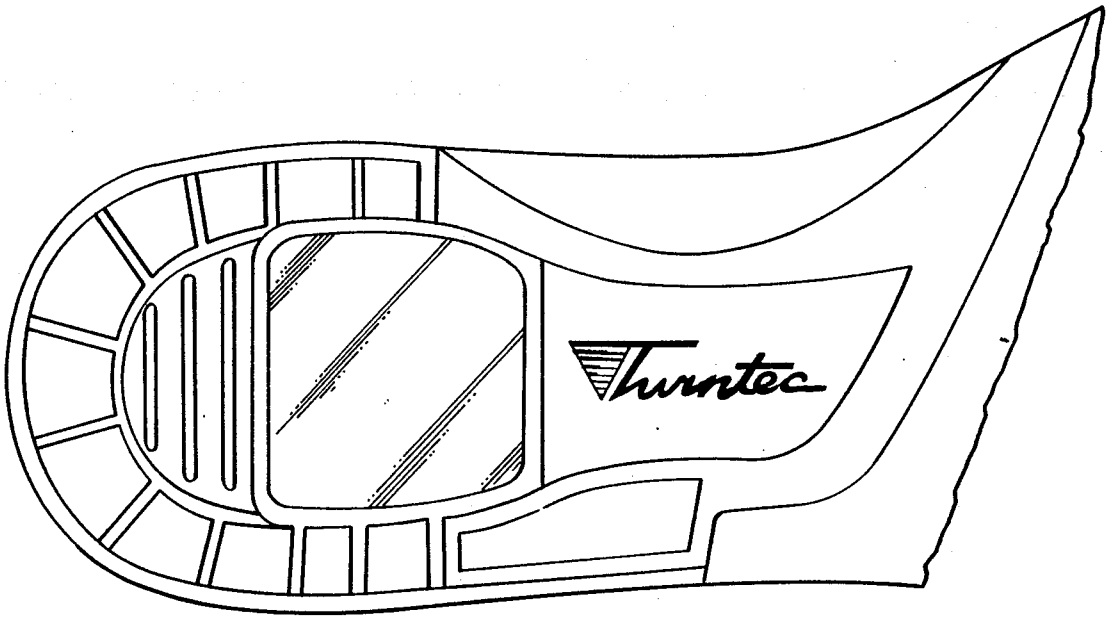
FIG. 4 is of the bottom of the outer sole with the shaded area representing a clear plastic window showing the joined modules.

As depicted in FIG. 4, there is a clear plastic window 14 extending over a bottom portion of the outer sole 10 to show the joined modules.

The remainder of the sneaker construction may be made of conventional materials using various designs.

We claim:

1. An athletic shoe comprising an upper shoe connected to a multilayer sole, said multilayer sole comprising in combination:

(a) an inner sole;

(b) an outer sole;

(c) a midsole intermediate between said inner and outer sole, said midsole having a cavity which is provided with a resilient member said resilient member comprising a first module having one or more parallel grooves which in cross-section have a triangular profile and a second module having one or more parallel raised strips which in cross-section have a triangular profile, said second module being joined to said first module by insertion of the raised strips of said second module into the grooves of said first module, and said joined first and second modules being located in said cavity of said midsole.

2. The athletic shoe according to claim 1 wherein said second module is made of a resilient elastomers.

3. The athletic shoe according to claim 2 wherein the cavity in the midsole is provided under the calcaneous bone.

4. The athletic shoe of claim 2 wherein the first module is made of a plastic having a Shore A hardness of 50°-60° C.

5. The athletic shoe according to claim 1 wherein said joined first and second modules are mounted transversely across the width of said athletic shoe such that the parallel grooves of said first module and the parallel raised strips of said second module are perpendicular to the longitudinal axis of said athletic shoe.

6. The athletic shoe according to claim 1 wherein a bottom portion of said outer sole has a clear plastic window to show said joined first and second modules.

7. The athletic shoe according to claim 5 wherein said first module is clear plastic and has number triangularly shaped parallel grooves, said second module is a rubber containing material and has number triangularly shaped parallel raised strips with blunted tips, and the bottom portion of said outer sole has a clear plastic window to show said joined first and second modules.

* * * * *